US011110323B2

(12) United States Patent
Conen

(10) Patent No.: US 11,110,323 B2
(45) Date of Patent: Sep. 7, 2021

(54) PRACTICE BALL

(71) Applicant: GORDON SPORTS LLC, Fairfax, CA (US)

(72) Inventor: Allan Conen, Sylvania (AU)

(73) Assignee: GORDON SPORTS LLC, Fairfax, CA (US)

( * ) Notice: Subject to any disclaimer, the term of this patent is extended or adjusted under 35 U.S.C. 154(b) by 0 days.

(21) Appl. No.: 16/077,151

(22) PCT Filed: Feb. 10, 2017

(86) PCT No.: PCT/AU2017/050107
§ 371 (c)(1),
(2) Date: Aug. 10, 2018

(87) PCT Pub. No.: WO2017/136888
PCT Pub. Date: Aug. 17, 2017

(65) Prior Publication Data

US 2019/0038941 A1 Feb. 7, 2019

(30) Foreign Application Priority Data

Feb. 10, 2016 (AU) ..... 2016900451

(51) Int. Cl.
*A63B 43/04* (2006.01)
*A63B 43/00* (2006.01)
(Continued)

(52) U.S. Cl.
CPC ..... *A63B 43/04* (2013.01); *A63B 41/00* (2013.01); *A63B 43/002* (2013.01);
(Continued)

(58) Field of Classification Search
CPC ..... A63B 43/04; A63B 69/002; A63B 41/00; A63B 2041/005; A63B 2209/00;
(Continued)

(56) References Cited

U.S. PATENT DOCUMENTS 996,458 A * 6/1911 Coleman ..... A63F 7/044 273/115
1,629,364 A * 5/1927 Scholly ..... A63B 43/04 473/594

(Continued)

FOREIGN PATENT DOCUMENTS

CN 2415814 Y * 1/2001
DE 197 03 387 8/1997

(Continued)

OTHER PUBLICATIONS

Pan, Zhiling, "Inflatable eccentric toy ball", CN 2,415.814Y, Jan. 24, 2001, retrieved on Nov. 13, 2020, Abstract and Drawing. (Year: 2001).*

(Continued)

*Primary Examiner* — Steven B Wong
(74) *Attorney, Agent, or Firm* — Nixon & Vanderhye P.C.

(57) ABSTRACT

A practice ball with an off-axis weight distribution allows sportspeople to practice their ball catching, passing and other skills using a ball that flies through the air with a wobbly trajectory.

7 Claims, 5 Drawing Sheets

(51) Int. Cl.
*A63B 69/00* (2006.01)
*A63B 41/00* (2006.01)

(52) U.S. Cl.
CPC ..... *A63B 69/002* (2013.01); *A63B 69/0053* (2013.01); *A63B 2041/005* (2013.01); *A63B 2209/00* (2013.01); *A63B 2243/007* (2013.01); *A63B 2243/0025* (2013.01); *A63B 2243/0066* (2013.01)

(58) Field of Classification Search
CPC .... A63B 2243/0025; A63B 2243/0066; A63B 2243/007; A63B 69/0053
See application file for complete search history.

(56) References Cited

U.S. PATENT DOCUMENTS 1,649,458 A * 11/1927 Fewlass ..... A63B 41/08 473/597
2,006,230 A * 6/1935 Dobbins ..... A63B 37/14 473/595
2,277,057 A * 3/1942 Bach ..... H01F 7/0221 473/570
2,364,247 A * 12/1944 Shearer ..... F16K 15/202 473/610
2,524,546 A * 10/1950 Sinclaire ..... A63H 33/26 473/570
3,450,407 A * 6/1969 Russo ..... A63B 37/08 473/438
3,995,855 A * 12/1976 Schultz ..... A63B 43/04 473/594
5,098,097 A * 3/1992 Kennedy ..... A63B 41/00 473/599
5,224,704 A * 7/1993 Snell ..... A63B 41/00 273/DIG. 20
5,261,661 A * 11/1993 Lemmon ..... A63B 41/00 273/DIG. 20
5,342,043 A * 8/1994 Baltronis ..... A63B 41/00 473/599
8,128,523 B2 * 3/2012 Laliberty ..... A63B 41/00 273/DIG. 20
9,017,192 B1 * 4/2015 Silva ..... A63B 41/00 473/594
9,289,657 B1 * 3/2016 Rice ..... A63B 43/04
2009/0286632 A1 * 11/2009 Laliberty ..... A63B 41/00 473/603
2011/0015010 A1 * 1/2011 Forrest, Sr. ..... A63B 41/00 473/594
2011/0118065 A1 * 5/2011 Krysiak ..... A63B 41/02 473/603
2014/0274498 A1 9/2014 Berggren
2019/0269980 A1 * 9/2019 Ragan ..... A63B 1/00

FOREIGN PATENT DOCUMENTS

FR 2 620 036 3/1989
GB 499656 1/1939
GB 2457941 A * 9/2009 ..... A63B 41/08
JP 2009050606 A * 3/2009
WO WO-9729807 A1 * 8/1997 ..... A63B 41/00
WO WO 98/30289 7/1998

OTHER PUBLICATIONS

International Search Report dated Mar. 30, 2017 issued in PCT International Patent Application No. PCT/AU2017/050107, 5 pp.
Extended European Search Report dated Aug. 5, 2019 issued in European Patent Application No. 17749830.0, 3 pp.

* cited by examiner

For round ball

| Practice Skill | Minimum Weight | Placement / Location |
|---|---|---|
| Hitting/kicking | 50g + | Centred |
| Hitting/kicking | 50g + | Centred – 2 positions |
| Bouncing/dribbling | 50g + | Centred |
| Bouncing/dribbling | 50g + | Centred – 2 positions |
| Passing/manoeuvring | 50g + | Centred |
| Passing/manoeuvring | 50g + | Centred – 2 positions |

Figure 8

For ellipsoid ball

| Practice Skill | Minimum Weight | Placement / Location |
|---|---|---|
| Kicking | 50g + | Centred |
| Kicking | 50g + | Centred – 2 positions |
| Bouncing | 50g + | Centred |
| Bouncing | 50g + | Centred – 2 positions |
| Passing/marking | 50g + | Centred |
| Passing/ marking | 50g + | Centred – 2 positions |

Figure 9

PRACTICE BALL

This application is the U.S. national phase of International Application No. PCT/AU2017/050107 filed Feb. 10, 2017 which designated the U.S. and claims priority to Australian Patent Application No. 2016900451 filed Feb. 10, 2016, the entire contents of each of which are hereby incorporated by reference.

FIELD OF THE INVENTION

The present invention relates to a practice ball. It also relates to practice techniques with a practice ball.

The invention has been developed primarily for use in/with practice balls used in one of a plurality of sports such as football or rugby and will be described hereinafter with reference to this application. However, it will be appreciated that the invention is not limited to this particular field of use. In particular it can be applied to a broad range of ball sports including netball, basketball, rugby, rugby league (ARL), grid iron, Australian football league (AFL), football also known as soccer, volleyball, futsal, water polo, etcetera.

BACKGROUND OF THE INVENTION

In the field of all sports that use balls, including such ball examples shown in FIGS. 1 to 4, there is the need to undertake extensive practice of a range of skills. This can include kicking skills, throwing skills, catching or marking skills, and hitting skills.

Referring to the drawings there is shown in FIGS. 1 and 2 two standard types of ball. In FIG. 1 there is shown a substantially spherical ball 10 which, by its surface structure and method of manufacture, typically comprises a plurality of hexagonal panels 11 sewn together to form an outer casing 12. This provides a particular historical textual feel and is usually formed of leather, although most massed produced balls are now made from a variety of other materials including various plastics. The manufacture of balls using different materials and manufacturing techniques, can result in the ball having different surface characteristics. In FIG. 2 there is shown a substantially ellipsoid ball 20. Historically this type of ball has a lace-up system 21 at the top to hold an internal bladder. Again these balls can be made of a variety of materials including leather and various plastics to provide different grip for use in different conditions such as wet weather.

Looking at FIG. 3 there are shown three known balls of the spherical shape including an Adidas branded World Cup football 10*a*, a Spalding brand American National Basketball Association (NBA) 10*b*, and a Nike brand volleyball 10*c*. There are many types of such spherical balls for a range of sports. Generally, they have a bladder for receiving air at a desired pressure to provide the ball with a particular uniform bounce. The amount of pressure and uniformity of the ball is integral to its acceptability for the chosen sport.

Looking at FIG. 4, there are shown three known balls of the ellipsoid shape including a Sherrin brand Australian Rules Football (AFL) 20*a*, a Steeden brand Australian Rugby League (ARL) football 20*b*, and a Wilson brand American National Football League (NFL) football 20*c*. These ellipsoid type balls vary slightly in shape, contour and texture from sport to sport and are matched to the type of sport and types of kicking and handling of the ball performed in that sport. Although they each may derive from a unique historical background, they still rely on a bladder for receiving air at a desired pressure to provide a ball with a particular uniform consistency. Again, the amount of pressure and uniformity of the ball is integral to its acceptability for the chosen sport.

The ball skills required by a player of a chosen ball sport requires the player to undertake precise techniques to maximise the chances of the correct technique being used automatically by the user during an actual game of the sport. Unfortunately, due to the repetitive nature and extended time that is required for such training, the player often loses concentration. Therefore the effectiveness of such training on the players ball handling skills can be lost.

It is important therefore to ensure that the player retains focus on the training technique and, in particular, focus on the ball so that it is in the correct relative position to the player undertaking a skill. This can be the way that the ball is dropped onto the foot in order to keep the correct alignment of the ball on the players foot when kicking. Alternatively, it can be the way that the hands are arranged in order to correctly catch or mark a ball, thrown or kicked to the player. Because of repetitive training, a player can lose focus and not watch the ball follow its entire path into their hands. It is therefore important to adopt training methods or provide suitable training devices to maintain the players focus throughout the entirety of the training session to achieve maximum benefit in practising the ball skills required to play the game.

It can be seen that a substantial element of a coach's responsibilities to the players is to organise the training sessions so as to maintain the intensity and focus the players have during training sessions. However, there is typically only one coach for the team, and that coach has a plurality of jobs to attend to. This includes research of opposition, preparation of game plan, selection of players, and interaction with a range of other medical, organisational, training, marketing or corporate people associated with the sporting club such that the coach is not generally able to provide undivided attention to all the team players throughout the coaching session to ensure each player receives sufficient one-on-one attention to the ball skills which may need refining and improvement. It is therefore important to allow the player to be more self-sufficient in training whilst retaining the players focus on learning and practising the ball skills required for the chosen sport and therefore maintain optimal effectiveness of training.

The present invention seeks to provide a practice ball configured such as to require increased player attention on the ball during training sessions, which will overcome or substantially ameliorate at least one or more of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE INVENTION

According to one aspect of the present invention, a practice ball is provided comprising:

- an outer casing comprising at least one axis of rotational symmetry;
- a bladder located within the outer casing;
- a means for introducing air into the bladder such that the outer casing can be expanded in use; and
- at least one weight located off the axis of rotational symmetry of the outer casing.

Preferably, the at least one weight is located at one or more locations of the following group of weight locations:

a) within an outer casing
b) adjacent an inner surface of the outer casing
c) adjacent an outer surface of the bladder
d) adjacent an inner surface of the bladder
e) within a wall of the bladder
f) at the bladder Preferably, the bladder comprises a wall and at least one portion of the wall has a relatively greater thickness than a main portion of the wall such that the at least one weight is provided by the at least one portion of the wall.

Preferably, the at least one weight is hardened rubber, silicone, plastic or PVC.

Preferably, the at least one weight is attached to an inside surface of the outer casing.

Preferably, the at least one weight is one or more discs.

Preferably, the at least one weight is between 20 g and 300 g.

Preferably, the sport defined shape is that of an American football, a size 4 rugby ball or a soccer ball and the at least one weight is one weight between 80 and 120 g.

Preferably, the weight is about 100 g.

Preferably, the sport defined shape is that of a size 5 rugby ball and the at least one weight is one weight between 130 and 170 g.

Preferably, the weight is about 150 g.

Preferably, the sport defined shape is that of a netball and the at least one weight is one weight between 150 g and 300 g.

Preferably, the weight is about 200 to 250 g.

According to another aspect of the present invention, a practice ball is provided comprising:

an outer casing having an inflatable sport defined shape comprising at least one axis of rotational symmetry;

a means for introducing air into the outer casing to inflate the outer casing;

at least one weight at one or more predetermined locations on the outer casing;

wherein the predetermined locations are configured such that the weight is located off-axis with respect to the at least one axis of rotational symmetry whereby the ball is able to be used for a practice skill in the sport.

Preferably, the at least one weight is hardened rubber, silicone, plastic or PVC.

Preferably, the at least one weight is attached to an inside surface of the outer casing.

Preferably, the at least one weight is one or more discs.

Preferably, the at least one weight is between 20 g and 300 g.

Preferably, the sport defined shape is that of an American football, a size 4 rugby ball or a soccer ball and the at least one weight is one weight between 80 and 120 g.

Preferably, the weight is about 100 g.

Preferably, the sport defined shape is that of a size 5 rugby ball and the at least one weight is one weight between 130 and 170 g.

Preferably, the weight is about 150 g.

Preferably, the sport defined shape is that of a netball and the at least one weight is one weight between 150 g and 300 g.

Preferably, the weight is about 200 to 250 g.

According to another aspect of the present invention, a method of providing a practice ball suitable for a sport being practiced is provided, including the steps of:

selecting the sport being practiced;

obtaining relevant characteristics of players of the ball;

determining details of suitable configuration of off-axis weights for selected sport and skill being practiced in light of relevant characteristics of players; and providing a ball with suitable configuration of off-axis weights.

Preferably, the method of providing a practice ball further provides a user input for receiving a selection from a predefined selection of sports.

Preferably, the method of providing a practice ball further provides a user input for receiving relevant characteristics of players of the ball including one or more of the following: general age category of players; general standard of skills of the players; general fitness of the players; general strength of the players; relevant climate conditions; and level of training required.

Preferably, the method of providing a practice ball further provides a determinator for determining a relevant predefined selection of skills to be practiced related to each of said predefined selection of sports.

Preferably, the method of providing a practice ball further provides a determinator for determining details of suitable configuration of off-axis weights for a selected sport and skill being practiced in light of relevant characteristics of players.

Preferably, the method of providing a practice ball further provides a database having a predefined selection of sports and a predefined selection of skills to be practiced related to each of said predefined selection of sports.

Preferably, the method of providing a practice ball further provides a database having details of suitable configuration of off-axis weights for selected sport and skill being practiced in light of relevant characteristics of players.

It can be seen that the invention of the practice ball provides the benefit of requiring a person to focus on the ball. In particular, with the addition of off-axis weights, there will be established a wobble in the ball whilst it is in flight. Therefore, instead of the usual path of a thrown ball that is automatically assumed, there would be a wobble in the ball's path, and more intense focus is required to follow the actual path of the practice ball in flight. This intensity of focus is helpful during training and provides an aid for the game when the intense focus, which is translated from the practice session to an actual game, overcomes the usual in-game fumbles that can be very costly and result in disadvantages to the fumbling team. These disadvantages can be, for example, 'knock-ons_ in rugby league in which the player does not catch the backward directed ball from a fellow player but knocks it forward resulting in a turnover of possession to the other team. Similarly, the lack of focus in an AFL game might result in a dropped ball and therefore an unsuccessful mark and the loss of the advantage of an unrestricted kick provided when a player completes a successful mark.

It can be seen that the invention of the method of providing a practice ball provides the benefit of establishing suitable practice skills that match the players and that allow the one practice ball to be modified to perform different required practice skills.

Other aspects of the invention are also disclosed.

BRIEF DESCRIPTION OF THE DRAWINGS

Notwithstanding any other forms which may fall within the scope of the present invention, embodiments/arrangements of the invention will now be described, by way of example only, with reference to the accompanying drawings in which:

FIGS. 8 and 9 are respectively illustrative tables of suitable configuration of off-axis weights for selected sport and skill being practiced in light of relevant characteristics of users that can apply in the method of providing a practice ball for sports requiring a round ball and an ellipsoid ball respectively.

DETAILED DESCRIPTION

Figure 1:
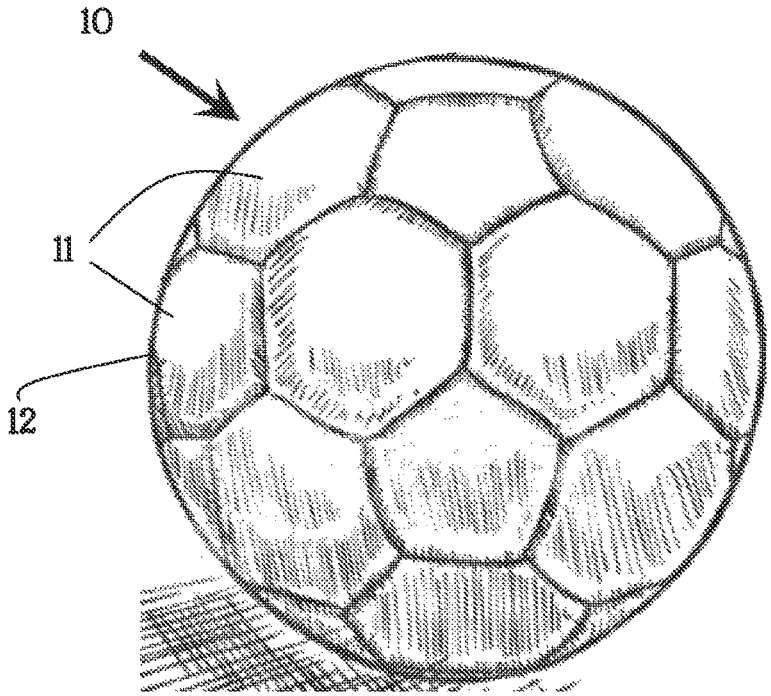
FIG. 1 is a round practice ball in accordance with a preferred arrangement of the present invention for use in a number of sports.

It should be noted in the following description that like or the same reference numerals in different figures or arrangements denote the same or similar features.

Practice Ball

Figure 2:
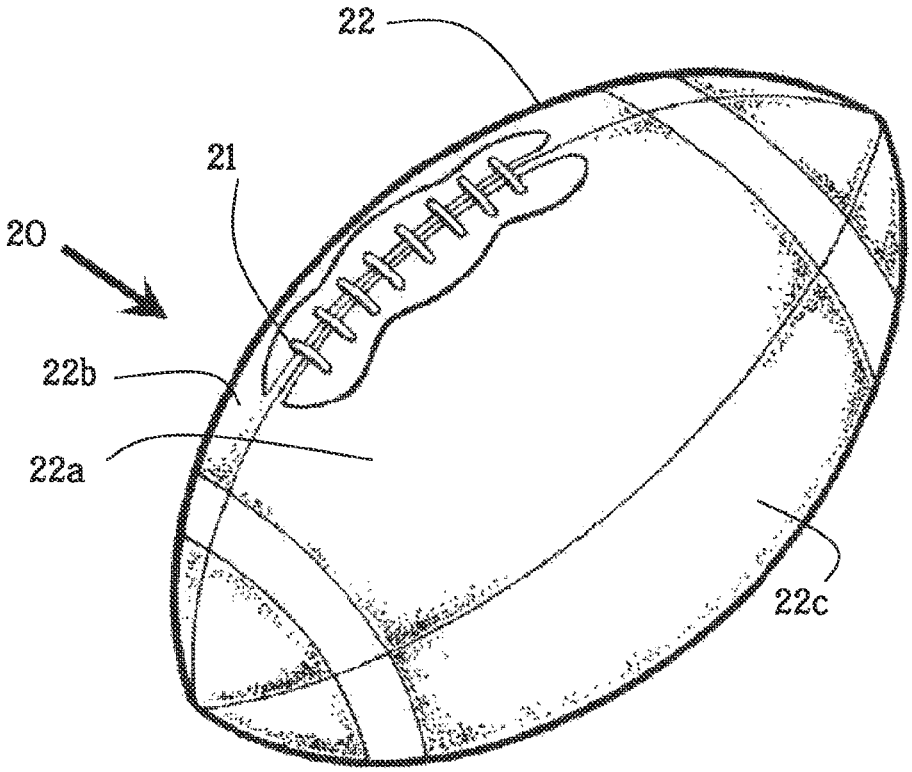
FIG. 2 is a substantially ellipsoid practice ball in accordance with another preferred arrangement of the present invention for use in a number of sports.
Figure 3:
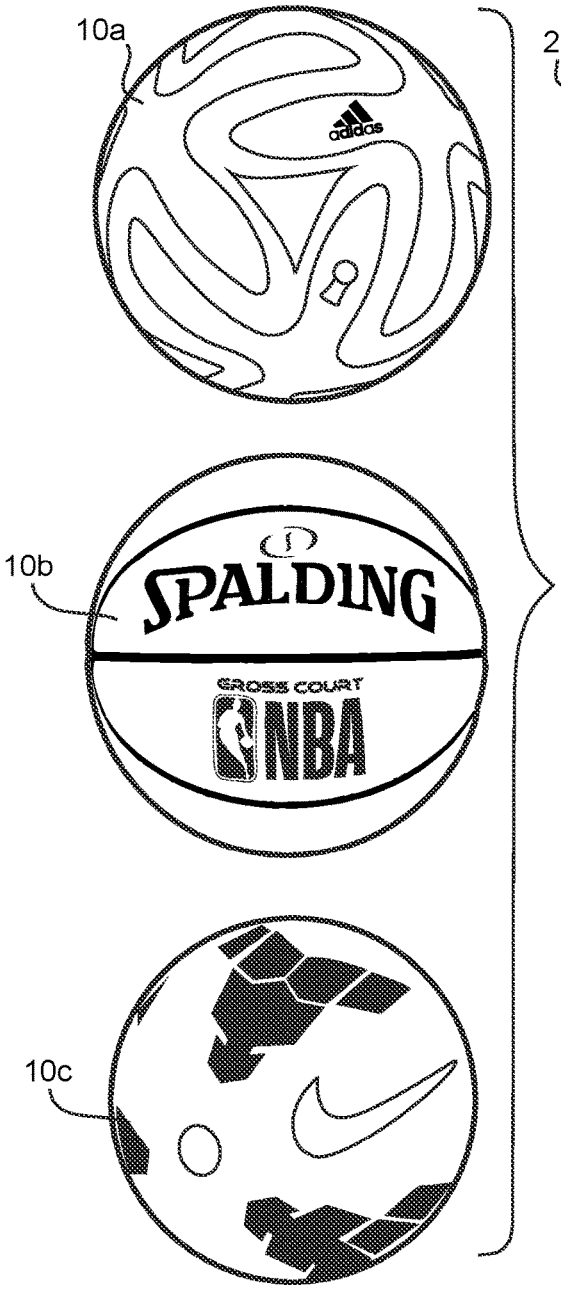
FIG. 3 shows examples of variations of the round ball that can be modified to be a round practice ball of FIG. 1 for particular sports.
Figure 4:
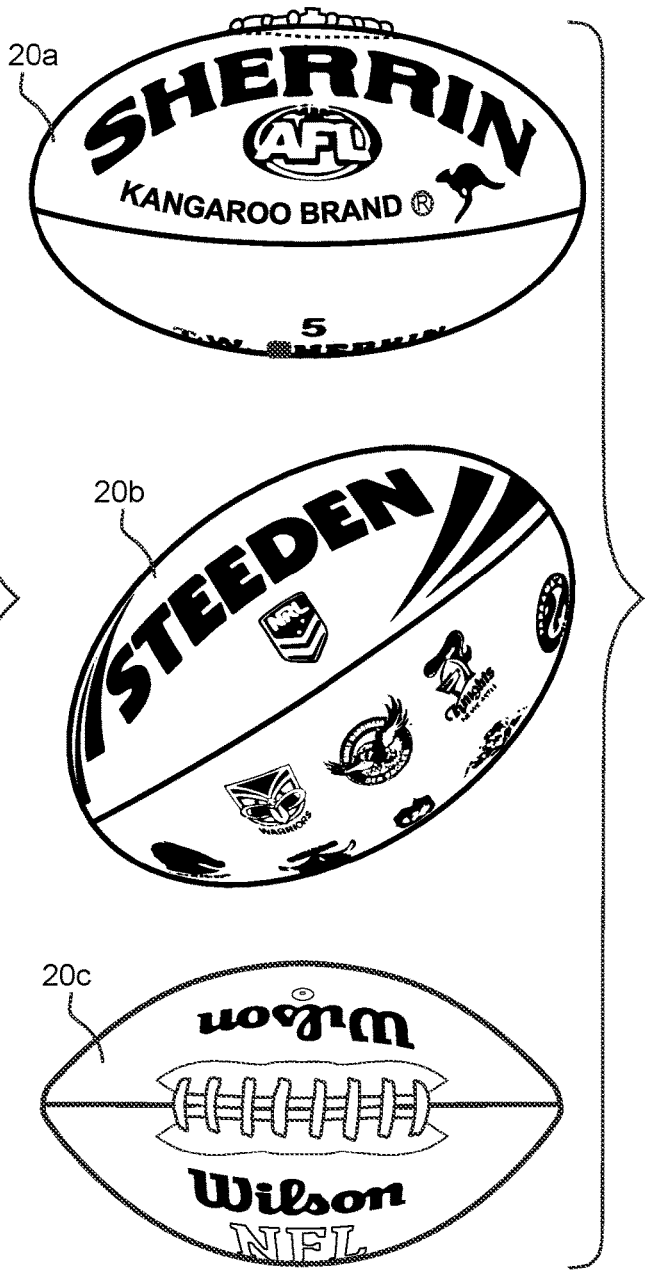
FIG. 4 are examples of variations of the substantially ellipsoid ball that can be modified to be a substantially ellipsoid practice ball of FIG. 1 for particular sports.

As shown in FIGS. 1 and 2 there are particular standard shapes of balls being a spherical ball 10 or an ellipsoid ball 20. Examples of the spherical ball 10 as shown in FIG. 3 can be a football (soccer ball) 10*a*, a basketball 10*b* or a volleyball 10*c*. The ball is typically formed from an outer casing 12 comprising a plurality of panels 11. Examples of the ellipsoid ball 20 as shown in FIG. 4 can be an AFL football 20*a*, a NRL football 20*b* or a Grid Iron NFL football 20*c*. Similarly, the ball is typically formed from an outer casing 22 comprising a plurality of panels e.g. 22A, 22B, 22C etc. The present invention can be applied to these balls and sports as well as to a number of other ball sports.

As a means of brevity the invention will be described with relation to the ellipsoid ball but will be clearly understood to be similarly applicable to the spherical ball.

Therefore in a particular preferred form there is provided a practice ball comprising an outer casing which has an inflatable shape specific to the sport for which the ball is designed such as, for example, the shapes shown in FIGS. 1 to 4. For the ball to be able to be used for a practice skill in the sport, there is further included a valve means for introducing air into the outer casing to inflate the ball.

Figure 5:
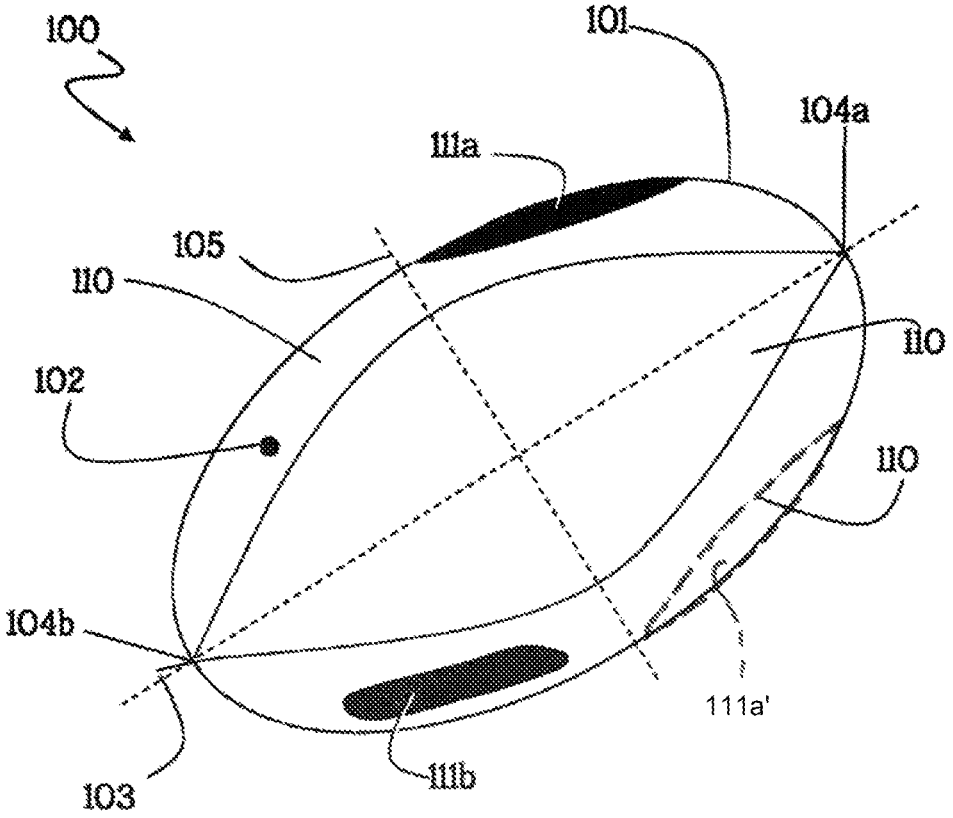
FIG. 5 shows a schematic view of an ellipsoid practice ball according to an arrangement of the invention as disclosed herein whereby the features thereof could be applied to a practice ball according to further arrangements of the invention disclosed herein fora practice ball having a round shape.

Referring to FIG. 5 there is depicted a practice ball 100 having an outer casing 101 which has an inflatable sport-defined shape.

The practice ball 100 has a valve means 102 for introducing air into the ball 100. Practice ball 100 includes a primary major axis 103 extending through the centre of the ball between distal ends of the ball 104*a* and 104*b*. Ball 100 further includes a secondary minor axis 105 which is rotationally symmetric (out of the page).

Practice ball 100 comprises additional weights, for example, weights 111*a* and/or 111*b*. Off-axis weights are positioned such that, when the ball is in flight, the additional weight(s) causes the ball to rotate about its centre of mass and about axes that are not coincident with major or minor axes 103 and 105.

The effect of the off-axis rotation caused by off-axis weights 111*a* and/or 111*b* is that the practice ball 100 when stationary looks and feels like a normal game ball. However as the ball is used, for example passed or kicked by a player, the ball exhibits an unexpected wobble. This effect can be adjusted for different skills being practiced and for different payers and age groups by altering the mass and/or placement of the off-axis weights. It will be readily appreciated that additional weights of a desired mass may be added to the ball 100 in additional locations provided that the weights are off-axis with respect to at least one rotational axis of the ball.

It will also be readily appreciated that additional weights may be added to practice ball 100 whereby the weights are located such that they are symmetric about one or more rotational axes of the ball, but wherein the weights are simultaneously not symmetrically disposed about a second axis of the ball, thus the ball will still exhibit an unexpected wobble due to rotation or spinning of the ball when in flight about the centre of mass (of the combined ball and weights) which is not coincident with the geometric centre of the ball 100. See, for example, weight 111*a*' in FIG. 5.

In particular arrangements of practice ball 100, the predetermined locations for receiving the weights are located on the inside of the outer casing 101 on an inner surface thereof so as not to interfere with the external shape of the ball. If the weights were located on the external surface of the outer casing, this is undesirable as the weights would interfere with the players ability to practice the required skills since the shape of the practice ball would be different to that of the ball used during gameplay.

Figure 6:
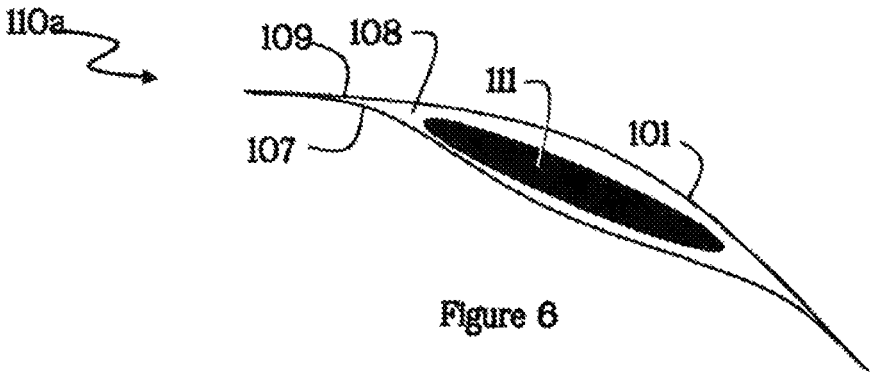
FIG. 6 shows a panel for forming the outer casing of a practice ball according to an arrangement of the invention as disclosed herein.

In typical arrangements as described above, the balls are usually formed from a plurality of panels 110 sewn together to form the outer casing 101 of the ball. In particular arrangements of practice ball 100, at least one of the plurality of panels 110*a* as shown in FIG. 6 comprises an inner panel 107 and an outer panel 109. In this particular arrangement, the predetermined location comprises a location 108 intermediate the inner and outer panels 107 and 109 for receiving weight 111.

In alternative embodiments, a practice ball is provided comprising:

- an outer casing comprising at least one axis of rotational symmetry and having a sport defined shape;
- a bladder located within the outer casing;
- a means for introducing air into the bladder such that the outer casing can be expanded in use; and
- at least one weight located off at least one of the at least one axis of rotational symmetry of the outer casing. In these embodiments, the practice ball may have one or more weights located at one or more locations of the following group of weight locations:

a) within an outer casing
b) adjacent an inner surface of the outer casing
c) adjacent an outer surface of the bladder
d) adjacent an inner surface of the bladder e) within a wall of the bladder; and/or f) at the bladder In various embodiments, the one or more weights may be hardened rubber, silicone, plastic or PVC so as to have some measure of elasticity or flexibility to avoid injuries. The one or more weights may be discs so as to avoid sharp edges.

The one or more weights may typically be between 20 g and 300 g each.

In one embodiment, the sport defined shape is that of an American football, a size 4 rugby ball or a soccer ball and the one or more weights is one weight being between 80 and 120 g. In another version of this embodiment, the weight is about 100 g.

In one embodiment, the sport defined shape is that of a size 5 rugby ball and the one or more weights is one weight being between 130 and 170 g. In another version of this embodiment, the weight is about 150 g.

In one embodiment, the sport defined shape is that of a netball and the one or more weights is one weight being between 150 and 300 g. In another version of this embodiment, the weight is between 200 and 250 g.

In yet another embodiment, the bladder within a practice ball may comprise a wall having one or more portions of relatively greater thickness than a main portion of the wall such that the one or more weights are provided by the one or more portions of the wall. The one or more portions of the wall may be, for example, 1.5, 2, 5 or even 10 times the thickness of the thickness of a majority portion of the rest of the wall. Each of the one or more portions of the wall may have a weight of between 20 g and 300 g.

Method for Providing a Practice Ball

Figure 7:
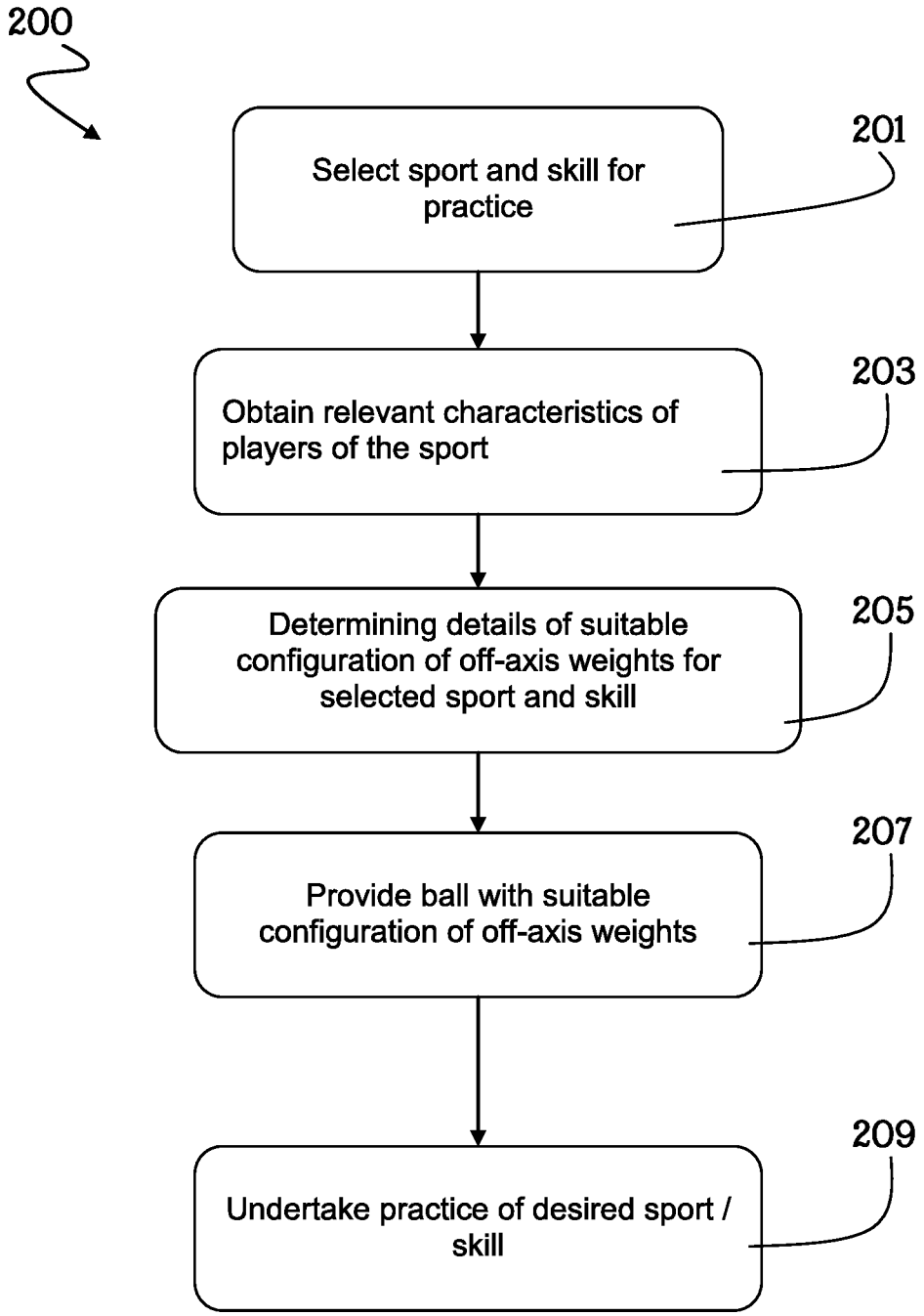
FIG. 7 is a flow diagram of a method of providing a practice ball according to an arrangement of the invention as disclosed herein.

Referring to FIG. 7 there is shown a method 200 of providing a practice ball suitable for a skill being practiced including the steps of:

a) Selecting 201 the sport and skill being practiced;

b) Obtaining 203 relevant characteristics of users of the ball;

c) Determining 205 details of suitable configuration of off-axis weights for selected sport and skill being practiced in light of relevant characteristics of users; and d) Provide ball 207 with suitable configuration of off-axis weights; and e) Undertake practice session of the desired sport/skill using the practice ball.

The method 200 of providing a practice ball further allows a user input for receiving a selection from a predefined selection of sports and a predefined selection of skills to be practiced related to each of said predefined selection of sports.

The method 200 of providing a practice ball further allows a user input for receiving relevant characteristics of users of the ball including one or more of the following:

i) General age category of users;

ii) General standard of skills of the users;

iii) General fitness of the users;

iv) General strength of the users v) Relevant climate conditions;

vi) Level of training required.

The method 200 of providing a practice ball further allows a determinator for determining a relevant predefined selection of skills to be practiced related to each of said predefined selection of sports.

The method 200 of providing a practice ball further allows a determinator for determining details of suitable configuration of off-axis weights for selected sport and skill being practiced in light of relevant characteristics of users.

The method 200 of providing a practice ball further allows a database having a predefined selection of sports and a predefined selection of skills to be practiced related to each of said predefined selection of sports.

The method 200 of providing a practice ball further allows a database having details of suitable configuration of off-axis weights for selected sport and skill being practiced in light of relevant characteristics of users.

Referring to the tables of FIGS. 8 and 9, there are examples of particular training skills and an approximate mass/placement of weights that can be added to the ball so as to not overly affect the skill being practice but to sufficiently provide a wobble to the ball to encourage continual high concentration in players practicing the skill.

Interpretation

Embodiments/Arrangements

Reference throughout this specification to 'one embodiment/arrangement_ or 'an embodiment/arrangement_ means that a particular feature, structure or characteristic described in connection with the embodiment/arrangement is included in at least one embodiment of the present invention. Thus, appearances of the phrases 'in one embodiment/arrangement_ or 'in an embodiment/arrangement_ in various places throughout this specification are not necessarily all referring to the same embodiment/arrangement, but may. Furthermore, the particular features, structures or characteristics may be combined in any suitable manner, as would be apparent to one of ordinary skill in the art from this disclosure, in one or more embodiments/arrangements.

Similarly it should be appreciated that in the above description of example embodiments/arrangements of the invention, various features of the invention are sometimes grouped together in a single embodiment/arrangement, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment/arrangement. Thus, the claims following the Detailed Description are hereby expressly incorporated into this Detailed Description, with each claim standing on its own as a separate embodiment/arrangement of this invention.

Furthermore, while some embodiments/arrangements described herein include some but not other features included in other embodiments/arrangements, combinations of features of different embodiments/arrangements are meant to be within the scope of the invention, and form different embodiments/arrangements, as would be understood by those in the art. For example, in the following claims, any of the claimed embodiments/arrangements can be used in any combination.

Different Instances of Objects

As used herein, unless otherwise specified the use of the ordinal adjectives 'first_ 'second_ 'third_ etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments/arrangements of the invention may be practiced without these specific details. In other instances, well-known methods, structures and techniques have not been shown in detail in order not to obscure an understanding of this description.

Terminology

In describing the embodiments/arrangements of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description of the invention, except where the context requires otherwise due to express language or necessary implication, the word 'comprise_ or variations such as 'comprises_ or 'comprising_ are used in an inclusive sense, i.e. to specify the presence of the stated features but not to preclude the presence or addition of further features in various embodiments/arrangements of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments/arrangements of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks.

The invention claimed is:

1. A practice ball comprising:

an outer casing comprising at least one axis of rotational symmetry;

a means for introducing air into the outer casing to inflate the outer casing; and at least one hardened rubber, silicone, plastic or PVC weight at one or more predetermined locations on the outer casing, wherein the at least one hardened weight is hardened rubber, silicone, plastic or PVC prior to being positioned at the one or more predetermined locations, wherein the predetermined locations are configured such that the weight is located off-axis with respect to the at least one axis of rotational symmetry of the outer casing, and wherein the at least one weight located at the one or more predetermined locations causes the practice ball in use to move in an eccentric fashion, the practice ball comprising a plurality of the hardened weights positioned such that the weights are symmetric about the at least one axis of rotational symmetry, and wherein the weights are simultaneously not symmetrically disposed about a second axis of the practice ball, whereby the ball is able to be used for a practice skill in a sport.

2. A practice ball according to claim 1 wherein the at least one weight is located at one or more locations of the following group of weight locations:

a. within an outer casing
b. adjacent an inner surface of the outer casing
c. adjacent an outer surface of the bladder
d. adjacent an inner surface of the bladder
e. within a wall of the bladder
f. at the bladder.

3. A practice ball according to claim 1 wherein the ball comprises a plurality of panels forming the outer casing; and wherein at least one of said plurality of panels comprises an inner and an outer panel wherein said predetermined location comprises a location intermediate said inner and outer panels.

4. A practice ball according to claim 1 wherein the at least one weight is one or more discs.

5. A practice ball according to claim 1, wherein the outer casing is in a shape of an American football, a size 4 rugby ball or a soccer ball and the at least one weight is one weight between 80 and 120 g.

6. A practice ball according to claim 1, wherein the outer casing is in a shape of a size 5 rugby ball and the at least one weight is one weight between 130 and 170 g.

7. A practice ball according to claim 1, wherein the outer casing is in a shape of a netball and the at least one weight is one weight between 150 g and 300 g.

* * * * *